US010358894B2

(12) United States Patent
Barbato

(10) Patent No.: US 10,358,894 B2
(45) Date of Patent: Jul. 23, 2019

(54) SYSTEM FOR PLACING A TRACER IN A WELL

(71) Applicant: Trican Completion Solutions Ltd., Calgary (CA)

(72) Inventor: Vincenzo Barbato, Richmond, TX (US)

(73) Assignee: DRECO ENERGY SERVICES ULC, Calgary, AB (CA)

( * ) Notice: Subject to any disclaimer, the term of this patent is extended or adjusted under 35 U.S.C. 154(b) by 262 days.

(21) Appl. No.: 14/967,013

(22) Filed: Dec. 11, 2015

(65) Prior Publication Data

US 2017/0167226 A1 Jun. 15, 2017

(51) Int. Cl.
*E21B 34/12* (2006.01)
*E21B 47/10* (2012.01)
*E21B 34/00* (2006.01)

(52) U.S. Cl.
CPC ..... *E21B 34/12* (2013.01); *E21B 47/1015* (2013.01); *E21B 2034/007* (2013.01)

(58) Field of Classification Search
CPC ..... E21B 34/12; E21B 47/10; E21B 47/1015; E21B 34/14
See application file for complete search history.

(56) References Cited

U.S. PATENT DOCUMENTS

2011/0277544 A1 11/2011 Rytlewski
2011/0277996 A1* 11/2011 Cullick ..... E21B 33/138 166/250.12
2013/0313825 A1* 11/2013 Pajak ..... F16L 1/028 285/419
2014/0231071 A1 8/2014 Walton
2015/0240598 A1 8/2015 Zhou

OTHER PUBLICATIONS

Search Report and Written Opinion for PCT/US2016/065886 dated Mar. 28, 2017 (17 pages).
Omega Completion Technology Ltd: "Tracer Valve (RTV)" dated Jun. 30, 2015 (2 pages).
Omega Completion Technology, Ltd. Brochure on ReAct Tracer Valve (RTV) Rev 001 Jun. 30, 2015 (2 pages).

* cited by examiner

*Primary Examiner* — Giovanna C Wright
*Assistant Examiner* — Manuel C Portocarrero
(74) *Attorney, Agent, or Firm* — Conley Rose, P.C.

(57) ABSTRACT

It has been found that in many instances it is desirable to be able to determine where fluid in a well originates. To that end a tracer assembly is provided where the tracer assembly becomes a portion of the tubular that is run into the wellbore. Preferably the tracer assembly provides an exterior barrier whether permanent or temporary to fluid flow outside of the tubular and also provides an interior barrier to fluid flow as it passes through the inner bore of the tubular. The interior barrier is adjustable so that upon command it provides access from the interior of the tubular to at least a portion of a cavity within the tracer assembly. The cavity is provided with a tracer or tracers so that as fluid is allowed within the interior cavity portion of the tracer is eroded, dissolved, or otherwise mixed with the fluid and the tracer that is now mixed with the fluid is transported to the surface.

30 Claims, 9 Drawing Sheets

SYSTEM FOR PLACING A TRACER IN A WELL

BACKGROUND

In the course of producing oil and gas wells, typically after the well is drilled, the well may be completed. One way to complete a well is to divide the well into several zones and then treat each zone individually.

Treating each section of the well individually may be accomplished in several ways. One way is to assemble a tubular assembly on the surface where the tubular assembly has a series of spaced apart sliding sleeves. Sliding sleeves are typically spaced so that at least one sliding sleeve will be adjacent to each zone. In some instances annular packers may also be spaced apart along the tubular assembly in order to divide the wellbore into the desired number of zones. In other instances when annular packers are not used to divide the wellbore into the desired number of zones the tubular assembly may be cemented in place.

The tubular assembly is then run into the wellbore typically with the sliding sleeves in the closed position. Once the tubular assembly is in place in the well and has been cemented in place or the packers have been actuated the wellbore may be treated.

In other instances a tubular assembly, the casing, is run into the open hole and then cemented into place. The cement and the casing provide zonal isolation. That in order to provide access to the wellbore a plug is run into the well and set below the lowest zone to which access is desired. The perforating gun is then run into the casing and placed adjacent to the producing formation and actuated to puncture the casing. The formation adjacent to the punctures in the casing are then treated by fracturing or other stimulation methods. Another plug is then run into the casing and is placed between the perforations in the casing and the next lowest formation zone. The perforation, stimulation, and plugging processes are repeated until all the zones are treated.

Once all the zones have been treated whether by plug-in per or by opening sliding sleeves and fracturing the plugs or other isolation equipment between the various zones within the casing are removed to allow formation fluid into the interior of the casing and to the surface.

Once the well is on production fluid flows from each of the formations through the adjacent ports or punctures in the casing and to the surface. Unfortunately it is difficult for the operator to determine whether or not fluid is coming from a particular formation, in what quantities it's coming from a particular formation and the quality of the fluid that is coming from a particular formation. The quality of the fluid from a particular formation is usually a function of the ratio of hydrocarbons to water is being produced by particular zone.

By having information related to the fluid production from each zone and operator may enhance the production of a well by closing zones that are either not producing any hydrocarbons or producing fluids having a high ratio of water to hydrocarbon content. Additionally such information would allow an operator to utilize well stimulation or artificial lift techniques at the appropriate stage in the well's life.

SUMMARY

It is envisioned that the addition of a tracer to the wellbore fluid would allow an operator to determine how much hydrocarbons and water that a well was producing. In particular it by adding a tracer material to the fluid produced from each formation zone would provide the operator with the required information as to the quantity of hydrocarbons and the ratio of hydrocarbons to water that was being produced by a particular zone. Each zone should have its own particular tracer material. Tracer materials may be chemicals, radioisotopes, radio frequency identification tags, identifiable beads, etc.

In one embodiment a sliding sleeve has an intermediate ported subassembly. The intermediate ported subassembly is typically located between the housing and the interior sliding sleeve. The intermediate ported subassembly provides, preferably, slots or at least an annular area between the housing and interior sliding sleeve. The slots or annular area in turn hold a preferably solid tracer material where the tracer material is allowed to contact the fluid in the well in a specific location within the ported subassembly. The tracer material in contact with the fluid dissolves, erodes, degrades, or otherwise mixes with the fluid to allow portions of the tracer material to be transported by the fluid from the intermediate ported subassembly to the surface.

Typically the tracer assembly housing is not ported. The interior sliding sleeve has ports through the interior sliding sleeve. In the run in or closed position the ports in the interior sliding sleeve are aligned with a blank portion of the housing or a blank portion of the intermediate ported subassembly thereby preventing fluid access from the interior of the tubular to the tracer material within the intermediate ported subassembly. The interior sliding sleeve is retained in the closed position by retaining device such as a shear pin, a C ring, or other retaining device.

Once the operator desires to open the interior sliding sleeve to allow access to the tracer material the interior sliding sleeve will be shifted from the closed position to the open position. It is anticipated that the sliding sleeve will be opened by dropping a ball, plug, or other obturating device that will flow through the interior of the tubular and when reaching the appropriate seat corresponding to the tracer assembly that the operator desires to open then the ball will form a seal with the seat to prevent further fluid flow past the seal so that pressure from the surface will act across the seal to create a force to overcome the retaining device thereby allowing the interior sliding sleeve to open. With the interior sliding sleeve now open ports in the interior sliding sleeve align with ports in the intermediate ported subassembly. The ports in the intermediate ported subassembly allow access to at least a portion of the tracer materials within the annular area created by the intermediate ported subassembly.

In an alternative design with the interior sliding sleeve open, an end of the interior sliding sleeve uncovers ports or slots within the intermediate ported subassembly allowing fluid communication with the tracer material within the annular area created by the intermediate ported subassembly. In some versions of the invention both an end of the interior sliding sleeve as well as ports through the interior sliding sleeve will uncover at least a portion of the tracer material within the intermediate ported subassembly allowing fluid communication between the interior of the tubular and the tracer material.

Typically when shifting the interior sliding sleeve with a ball, plug, or obturating device, once the interior sliding sleeve has shifted the seat moves from an initial supported position within the housing to an unsupported position which allows the seat to expand thereby permitting the ball to proceed through the tubular and to the next appropriately sized tracer assembly or to another tool which may be actuated by the ball.

In another embodiment of the invention it is envisioned that the tracer assembly is also ported to the exterior of the housing so that the sliding sleeve may be used as a frac sliding sleeve. In such instances the exterior housing port may or it be covered by a sheath, a frangible plug within the port, or other means to protect the tracer material within the intermediate ported subassembly.

The tracer materials within the intermediate ported subassembly are generally biased so that fluid flow may only reach the portion of the tracer material exposed to a port and as that material is eroded, dissolved or otherwise removed the tracer material within the intermediate ported subassembly is fed to the port by the biasing device. Where the biasing device could be compressed gas, gravity, spring, etc.

In certain instances the tracer material may be more readily soluble in hydrocarbons or more readily soluble in water such that the type of fluid flow past the tracer material would remove more or less of the tracer material depending upon the type of fluid flow thereby giving an indication as to the type of material i.e. water or oil. In some instances the tracer material may be insoluble and having a soluble binder.

Typically the tracer material would be placed above a particular zone even if the zone had multiple "take points". For instance a particular zone may have five sliding sleeves to access the zone and only a single tracer assembly above the uppermost sliding sleeve allowing a determination to be made how much fluid is coming from a particular zone. Each zone may have a different tracer material to help determine what a particular stage or zone's contribution to the total fluid flow may be. As fluid flows through the port where the tracer material is in fluid communication with the tracer, the amount of tracer picked up by the flow is proportional to the amount of flow that goes past it.

By putting a tracer assembly at strategic points in the well and then sampling the fluid at the surface it may be determined that a particular tracer material "A" is present and a particular amount of tracer material "B" is present therefore we can say that a certain amount of fluid moved past the tracer assembly having tracer material "A" and another amount of fluid moved past the tracer assembly having tracer material "B".

In certain instances multiple tracer assemblies may be stacked one above the other in a wellbore to provide more tracer material at a particular zone or stage.

DETAILED DESCRIPTION

The description that follows includes exemplary apparatus, methods, techniques, and instruction sequences that embody techniques of the inventive subject matter. However, it is understood that the described embodiments may be practiced without these specific details.

Figure 1:
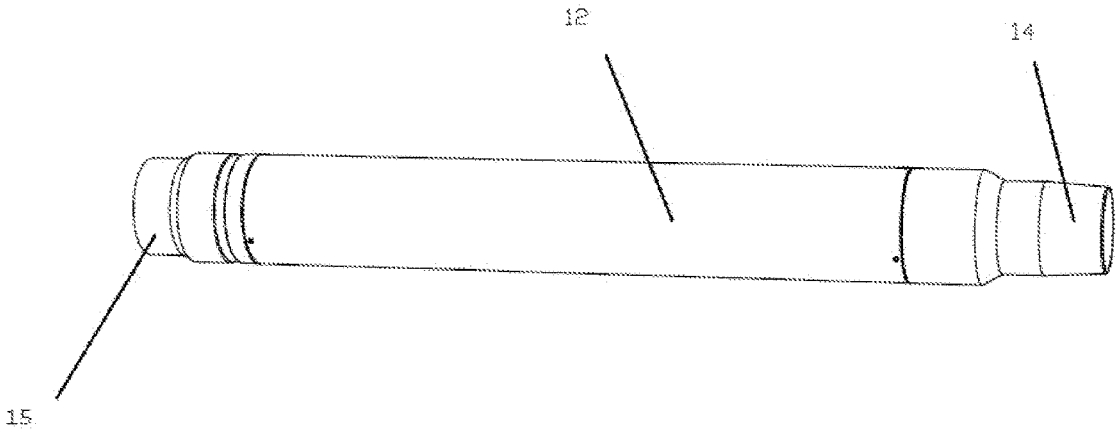
FIG. 1 depicts a tracer assembly having a non-ported external housing.

FIG. 1 depicts a tracer assembly 10 having a non-ported external housing 12 a lower end 14 and an upper end 15.

Figure 2:
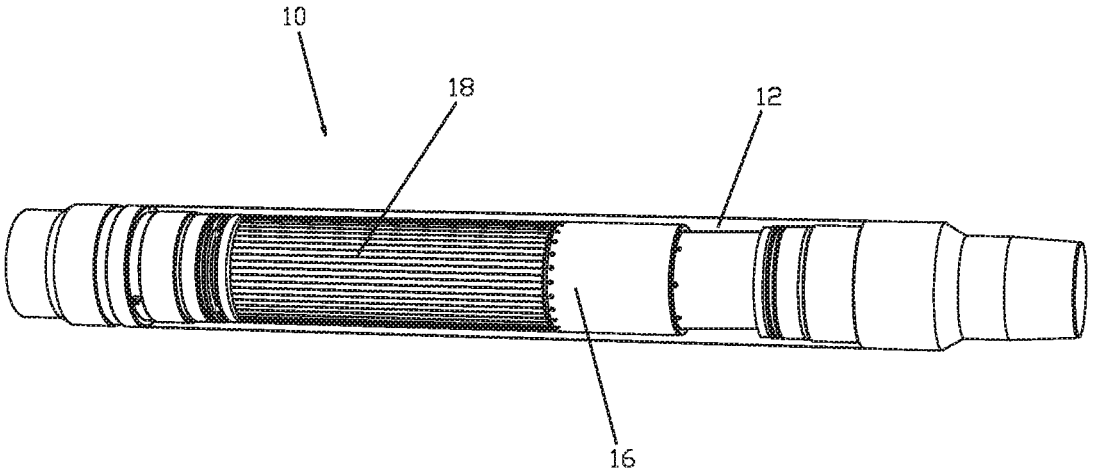
FIG. 2 depicts a view of the tracer assembly with the housing cutaway.

FIG. 2 depicts a view of the tracer assembly 10 with the housing 12 cutaway to reveal the external portion of the intermediate ported subassembly 16 with rows of tracer material 18 in a ported annular area formed by the housing 12 and a recess in the intermediate ported subassembly 16.

Figure 3:
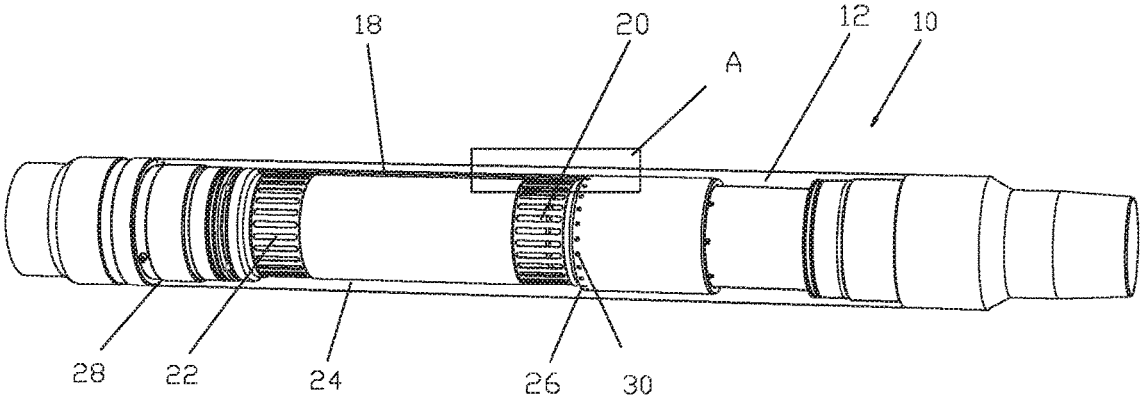
FIG. 3 depicts the ported subassembly having a portion of the housing cutaway and with most of the tracer material removed.

FIG. 3 depicts the ported subassembly 10 having a portion of the housing 12 cutaway and most of the tracer material 18 has been removed in order to depict a first set of ports 20 and a second set of ports 22. As can be seen a recessed area 24 is formed between the intermediate ported subassembly's first shoulder 26 and the intermediate ported subassembly's second shoulder 28. The tracer material 18 is placed within the recessed area where it is retained within the recessed area by the housing 12, an exterior of the intermediate ported subassembly 16, the intermediate ported subassembly's first shoulder 26, and the intermediate ported subassembly second shoulder 28.

Figure 4:
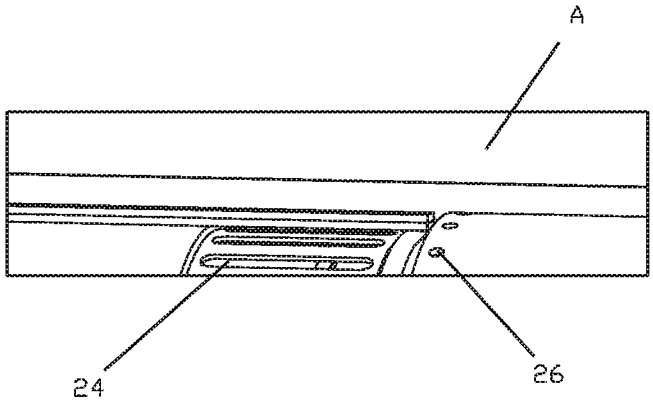
FIG. 4 is a view of the inset A of the tracer assembly from FIG. 3.

FIG. 4 is a view of the inset A of the tracer assembly 10 from FIG. 3 showing the recessed area 24, the first set of ports 20, the tracer material 18, the front shoulder 26, and shear pins 30.

Figure 5:
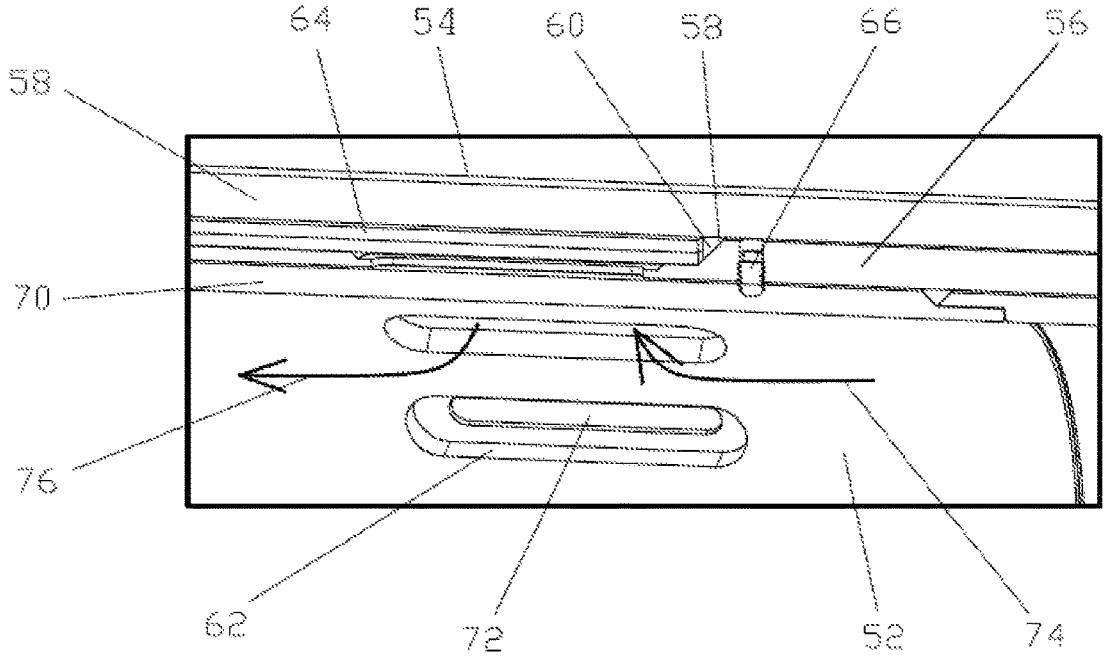
FIG. 5 depicts a partial cross section of a tracer subassembly.

FIG. 5 depicts a partial cross section of a tracer subassembly 50 having a tubing interior 52, a housing 54, and intermediate ported subassembly 56, a front shoulder 58, a recessed area 60, the first set of ports 72, shear pin 66, interior sliding sleeve 70, interior sliding sleeve ports 62, and tracer material 64. As depicted in FIG. 5 interior sliding sleeve 70 has been shifted to align the first set of ports 72 with interior sliding sleeve ports 62 thereby allowing fluid communication between the tubing interior 52 and tracer material 64 within recessed area 60. Typically as fluid moves upwards through the wellbore past the tracer assembly 50 the fluid flow as depicted by arrow 74 will pass through interior sliding sleeve ports 62, through the first set of ports 72 and erode at least a portion of tracer material 64. The fluid will then carry the tracer material 64 back out through the first set of ports 72, through the interior sliding sleeve ports 62, and towards the surface as indicated by arrow 76.

Figure 6:
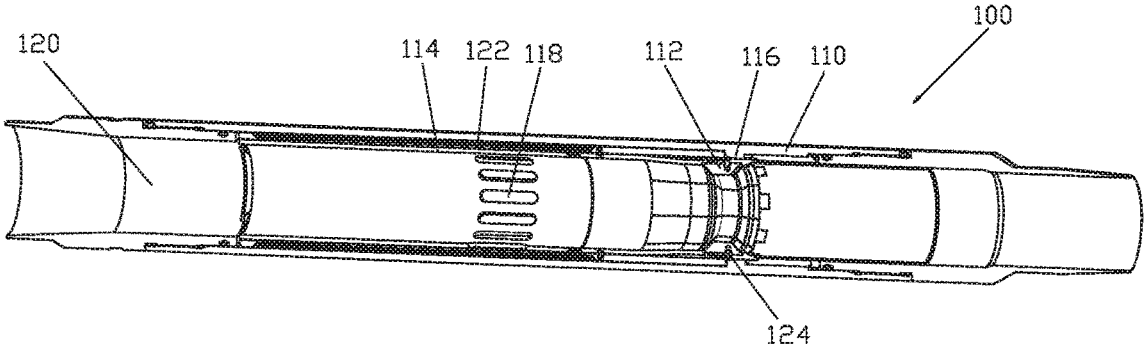
FIG. 6 depicts the tracer assembly with the interior sliding sleeve and seat in the upwards or closed position.

FIG. 6 depicts a cutaway view of a tracer subassembly 100, having a housing 110, a seat 112, seat support 116, ports 118, and interior sliding sleeve 114. FIG. 6 depicts the tracer subassembly 100 in the closed or run in position such that the ports 118 are aligned with a solid portion of the intermediate ported subassembly 122 thereby preventing any fluid flow from the interior of the tubular 120 through the ports 118 and to the tracer material that is protected from fluid flow by the housing 110 the interior sliding sleeve 114 and the intermediate ported subassembly 122. In the closed position the interior sliding sleeve 114 is retained in its position by shear pins 124. The seat 112 is supported by shoulder 116 that extends radially inward from the housing 110. With the seat 112 supported by shoulder 116 when a ball or plug configured to correlate to seat 112, not shown, progresses through the interior of the tubular 120 the ball will land on seat 112 forming a seal such that fluid is not allowed to progress past seat 112 with the ball in place. Fluid pressure from the surface may then be exerted against the ball and seat such that the ability of the shear pin 124 to retain the interior sliding sleeve 114 in the closed position is overcome. The ball and seat 112 in conjunction with fluid pressure from the surface will shift the interior sliding sleeve 114 from the closed position to the open position.

Figure 7:
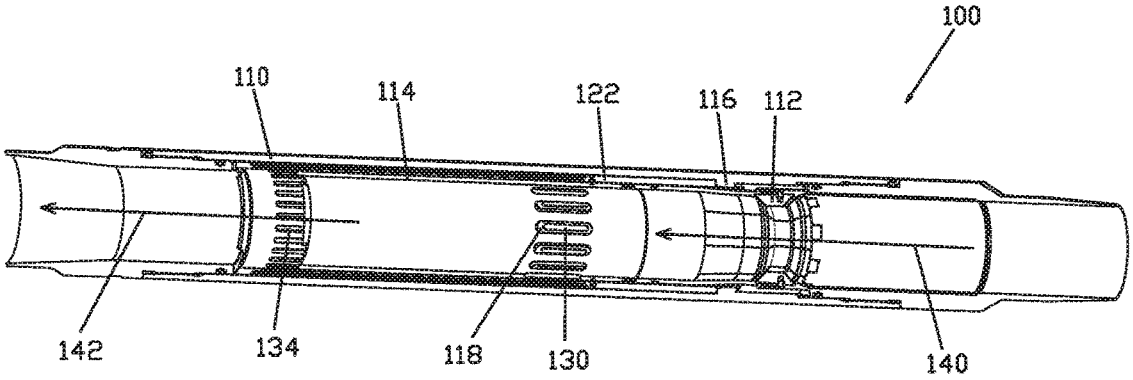
FIG. 7 depicts the tracer assembly with the interior sliding sleeve and seat shifted downward.

In FIG. 7 the tracer assembly 100 is shown with the interior sliding sleeve 114 and seat 112 shifted downward. With the seat 112 shifted downward seat 112 is no longer supported by shoulder 116 extending radially inward from housing 110. As the seat is no longer supported by shoulder 116 the seat 112 is no longer able to support the ball when sufficient pressure is applied from the surface thereby allowing the ball to expand the fingers of the seat 112 and passed downward in the well to the next appropriately configured tool. With interior sliding sleeve 114 now in the open position the sliding sleeve ports 118 are able to align with the first set of ports 130 of the intermediate ported subassembly 122 while the upper end of the interior sliding sleeve 114 exposes the second set of ports 134 of the intermediate ported subassembly 122. It is envisioned that the interior sliding sleeve 114 may be configured, as needed, to either expose the first set of ports 130 in the interior ported subassembly 122, to expose the second set of ports 134 in the interior ported subassembly 122, or to expose both as depicted in FIG. 7. With any of the first or second set of ports 130 or 134 exposed to fluid flow wellbore fluid progressing up the well past the exposed ports within the tracer subassembly 100 as depicted by arrow 140 will erode a portion of the tracer material within the intermediate ported subassembly 122 and transport that tracer material to the surface as depicted by arrow 142. In the event that only the first set of ports 130 are opened to allow fluid communication into the annular area between the housing 110 and the interior sliding sleeve 114 a localized area for contact between the wellbore fluid and the tracer material is created.

Figure 8:
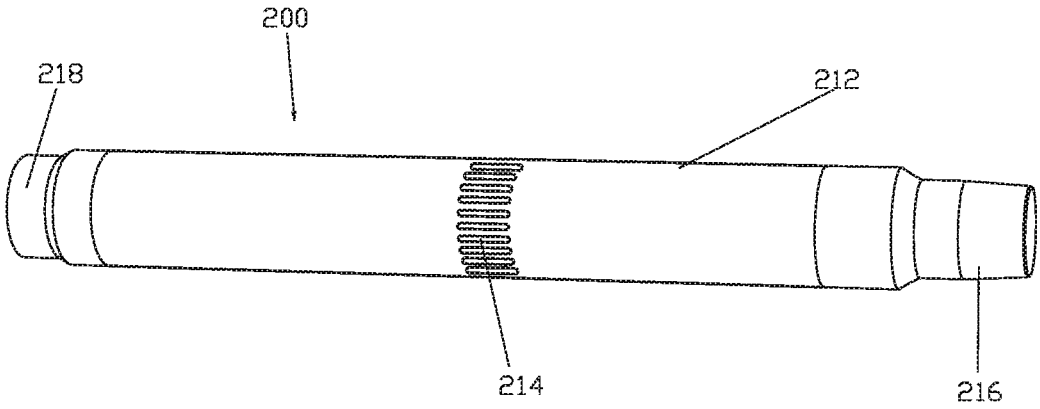
FIG. 8 depicts a fracturing tracer assembly having an external housing, a lower end, and an upper end.

FIG. 8 depicts a fracturing tracer assembly 200 having an external housing 212, a lower end 216 and an upper end 218. Ports 214 extend through the housing 212 to the annular space between the housing and the inner sleeve within which is typically the intermediate ported subassembly.

Figure 9:
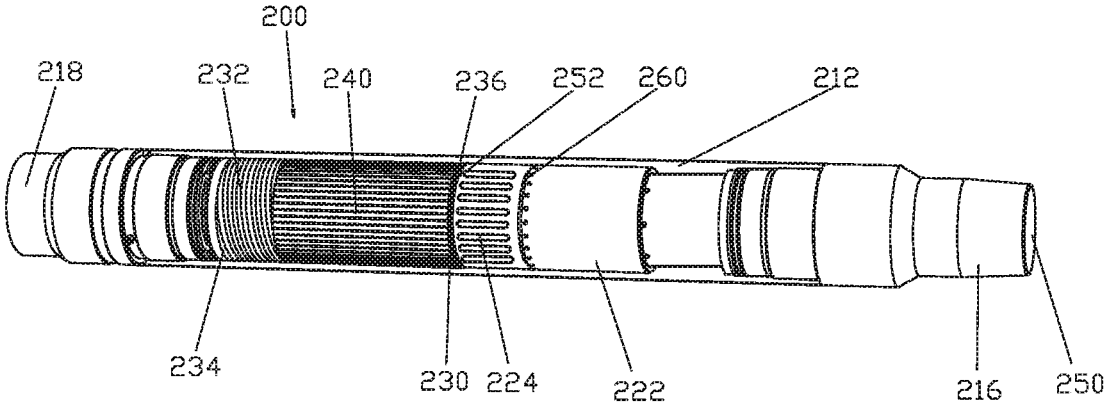
FIG. 9 depicts the fracturing tracer assembly of FIG. 8 with the housing partially cut away.

FIG. 9 depicts the fracturing tracer assembly 200 of FIG. 8 with the housing 212 partially cut away. In the fracturing tracer assembly 200 a shoulder 230 extends radially outward from the intermediate ported subassembly 222. In certain instances the shoulder 230 may be extend radially inwards from the housing 212, or may be a separate piece as long as the shoulder 230 creates localized area for contact between the fluid flow and the tracer material 240. Ports 224 extend through the intermediate ported subassembly 222 and are generally aligned with the ports 214 in the external housing 212. A biasing device in this instance the spring 232 abuts shoulder 234 within recess 236 where the recessed 236 is formed by shoulder 230 shoulder 234 and an exterior surface of intermediate ported subassembly 222. Tracer material 240 is held within recess 236 and is generally placed circumferentially around the intermediate ported subassembly 222 and within the recess 236. The spring 232 biases the tracer assembly 240 towards shoulder 230. When an interior sliding sleeve is open, ports in the interior sliding sleeve generally align with the ports 224 and the ports 214. In any event the interior sliding sleeve ports, the ports 224, and the ports 214 provide fluid communication between the interior of the tubular 250 and the formation (not shown). After the formation is treated, as fluid flows from the formation and through ports 214 towards ports 224 the fluid flows past shoulder 230. Laterally directed ports 252 within shoulder 230 allow the fluid to access the tracer material 240 within recess 236. As the fluid moved past the tracer material 240 a portion of the tracer material 240 will erode or otherwise be transported by the fluid into the interior of the tubular 250 and up to the surface.

In certain instances the intermediate ported subassembly 222 will not be provided with shoulder 230 thereby allowing the tracer material 240 to extend between ports 224 of the intermediate ported subassembly 222 and ports 214 of the external housing 212 abutting shoulder 260 of the intermediate ported subassembly 222. In such instances lateral channels (not shown) may be provided within recess 236 to provide for fluid flow around the tracer material 240 where the tracer material 240 extends between ports 224 the intermediate ported subassembly 222 and ports 214 of the external housing 212. In such an event the tracer material 240 may be provided as sticks or pellets within each channel and each channel may be equipped with an independent biasing means.

Bottom, lower, or downward denotes the end of the well or device away from the surface, including movement away from the surface. Top, upwards, raised, or higher denotes the end of the well or the device towards the surface, including movement towards the surface. While the embodiments are described with reference to various implementations and exploitations, it will be understood that these embodiments are illustrative and that the scope of the inventive subject matter is not limited to them. Many variations, modifications, additions and improvements are possible.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A tracer subassembly comprising:

a housing having a longitudinal throughbore, wherein an intermediate ported subassembly is positioned within the housing, an inner sleeve within the housing, wherein the inner sleeve comprises sleeve ports, wherein the inner sleeve has at least a first position and a second position, an annular space between the housing and the inner sleeve, a tracer material configured to dissolve, degrade, or mix with fluid from a formation, wherein the tracer material is circumferentially disposed around the intermediate ported subassembly within the annular space, a first set of ports positioned on the intermediate ported subassembly; and a second set of ports positioned on the intermediate ported subassembly;

wherein the first set of ports is positioned uphole from the second set of ports;

wherein the inner sleeve is configured to slide within the housing and align the sleeve ports with the first set of ports and the second set of ports to receive the fluid from the formation.

2. The tracer subassembly of claim 1 wherein, the sleeve in the first position prevents fluid communication between the throughbore and the annular space.

3. The tracer subassembly of claim 1 wherein, the sleeve in the second position allows fluid communication between the throughbore and the annular space.

4. The tracer subassembly of claim 1 wherein, the tracer material is a chemical tracer.

5. The tracer subassembly of claim 1 wherein, the tracer material is radioactive.

6. The tracer subassembly of claim 1 wherein, the tracer material is a radiofrequency identification tag.

7. The tracer subassembly of claim 1 wherein, the tracer material is a color-coded solid.

8. A tracer subassembly comprising:

a housing having a longitudinal throughbore, wherein an intermediate ported subassembly is positioned within the housing, an inner sleeve within the housing, wherein the inner sleeve comprises sleeve ports, wherein the inner sleeve has at least a first position and a second position, an annular space between the housing and the inner sleeve, a radially extending port between the annular space and the exterior of the housing allowing fluid communication between the annular space and the exterior of the housing, a tracer material configured to dissolve, degrade, or mix with fluid from a formation, wherein the tracer material is circumferentially disposed around the intermediate ported subassembly within the annular space, a first set of ports positioned on the intermediate ported subassembly; and a second set of ports positioned on the intermediate ported subassembly;

wherein the first set of ports is positioned uphole from the second set of ports;

wherein the inner sleeve is configured to slide within the housing and align the sleeve ports with the first set of ports and the second set of ports to receive the fluid from the formation.

9. The tracer subassembly of claim 8 further comprising a plug in the radially extending port between the annular space and the exterior of the housing preventing fluid communication between the annular space and the exterior of the housing.

10. The tracer subassembly of claim 8 further comprising a cover on the exterior of the housing preventing fluid communication between the annular space and the exterior of the housing through the radially extending port.

11. The tracer subassembly of claim 8 wherein, the sleeve in the first position prevents fluid communication between the throughbore and the annular space.

12. The tracer subassembly of claim 8 wherein, the sleeve in the second position allows fluid communication between the throughbore and the annular space.

13. The tracer subassembly of claim 8 wherein, the tracer material is a chemical tracer.

14. The tracer subassembly of claim 8 wherein, the tracer material is radioactive.

15. The tracer subassembly of claim 8 wherein, the tracer material is a radiofrequency identification tag.

16. The tracer subassembly of claim 8 wherein, the tracer material is a color-coded solid.

17. A tracer subassembly comprising:

a housing having a longitudinal throughbore, an inner sleeve within the housing, wherein the inner sleeve comprises sleeve ports, wherein the inner sleeve has at least a first position and a second position, an annular space between the housing and the inner sleeve, a tracer material configured to dissolve, degrade, or mix with fluid from a formation, wherein the tracer material is circumferentially disposed around the intermediate ported subassembly within the annular space, an intermediate ported subassembly between the inner sleeve and the annular space wherein the intermediate ported subassembly limits fluid communication between the throughbore and the tracer material to a localized area when the inner sleeve is in the second position;

a first set of ports positioned on the intermediate ported subassembly; and a second set of ports positioned on the intermediate ported subassembly;

wherein the first set of ports is positioned uphole from the second set of ports;

wherein the inner sleeve is configured to slide within the housing and align the sleeve ports with the first set of ports and the second set of ports to receive the fluid from the formation.

18. The tracer subassembly of claim 17 wherein, the intermediate ported subassembly limits fluid communication to a localized area adjacent to a port in the intermediate ported subassembly.

19. The tracer subassembly of claim 18 wherein, the tracer material is biased towards the localized area.

20. The tracer subassembly claim 17 wherein, the intermediate ported subassembly limits fluid communication to a localized area adjacent to a shoulder in the annular space.

21. The tracer subassembly of claim 20 wherein, the tracer material is biased towards the localized area.

22. The tracer subassembly of claim 17 further comprising a radially extending port between the annular space and the exterior of the housing allowing fluid communication between the annular space and the exterior of the housing.

23. The tracer subassembly of claim 22 further comprising a plug in the radially extending port between the annular space and the exterior of the housing preventing fluid communication between the annular space and the exterior of the housing.

24. The tracer subassembly of claim 22 further comprising a cover on the exterior of the housing preventing fluid communication between the annular space and the exterior of the housing through the radially extending port.

25. The tracer subassembly of claim 17 wherein, the sleeve in the first position prevents fluid communication between the throughbore and the annular space.

26. The tracer subassembly of claim 17 wherein, the sleeve in the second position allows fluid communication between the throughbore and the annular space.

27. The tracer subassembly of claim 17 wherein, the tracer material is a chemical tracer.

28. The tracer subassembly of claim 17 wherein, the tracer material is radioactive.

29. The tracer subassembly of claim 17 wherein, the tracer material is a radiofrequency identification tag.

30. The tracer subassembly of claim 17 wherein, the tracer material is a color-coded solid.

* * * * *